United States Patent [19]

Bemiss

[11] 3,976,241

[45] Aug. 24, 1976

[54] METHOD OF FORMING, FILLING AND CLOSING CARTONS, AND SPECIFIC CARTONS THEREFOR

[76] Inventor: Robert P. Bemiss, 925 Vista Road, Hillsborough, Calif. 94010

[22] Filed: Aug. 21, 1975

[21] Appl. No.: 606,458

Related U.S. Application Data

[60] Continuation-in-part of Ser. No. 453,087, March 20, 1974, Pat. No. 3,927,505, which is a division of Ser. No. 347,411, April 3, 1973, Pat. No. 3,812,641.

[52] U.S. Cl. ..... 229/51 TS; 229/23 BT; 229/33; 229/43; 229/51 D

[51] Int. Cl.[2] ..... B05D 5/54

[58] Field of Search ..... 229/51 TS, 51 D, 23 R, 229/23 BT, 43, 31 R, 33, 36; 426/122, 123

[56] References Cited

UNITED STATES PATENTS

| | | | |
|---|---|---|---|
| 1,717,367 | 6/1929 | Byrne | 229/51 P |
| 2,854,799 | 10/1958 | Griese et al. | 229/51 TS |
| 3,140,037 | 7/1964 | Baum et al. | 229/31 R |
| 3,206,103 | 9/1965 | Bixler | 229/51 TS |
| 3,231,172 | 1/1966 | Strange | 229/51 TS |
| 3,246,829 | 4/1966 | Sexton | 229/31 R |
| 3,520,466 | 7/1970 | Vokes et al. | 229/51 TS |

*Primary Examiner*—George E. Lowrance
*Assistant Examiner*—Bruce H. Bernstein
*Attorney, Agent, or Firm*—Diller, Brown, Ramik & Wight

[57] ABSTRACT

This disclosure relates to an easy opening package including a carton body having a bottom panel and four upstanding side panels terminating in free terminal upper edges and the cover including a top panel and four depending side panels, a tear strip formed in one cover side panel dividing the latter into upper and lower panel portions, and a carton body side wall underlying the one cover side wall including a pair of spaced weakening lines whereby upon removal of the tear strip the one carton body side panel can be opened by rupturing along the weakening lines to gain access to a product adapted to be packaged within the package.

8 Claims, 9 Drawing Figures

FIG. 1
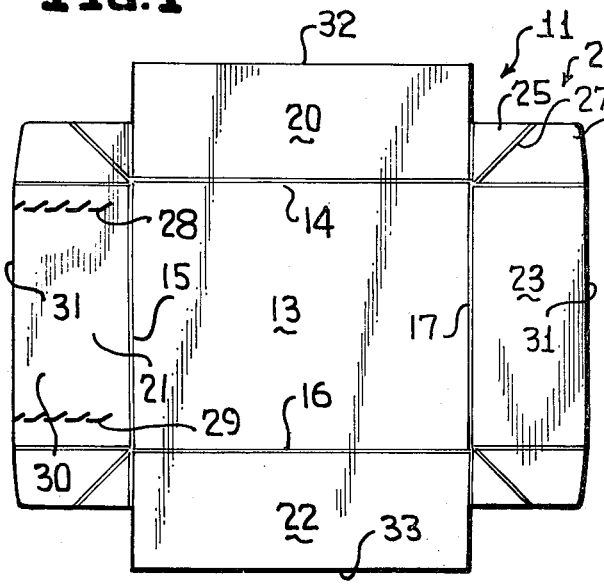
FIG. 4
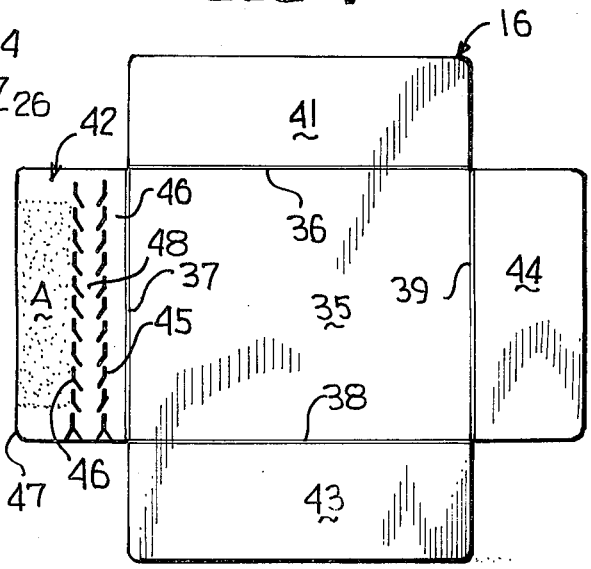
FIG. 2
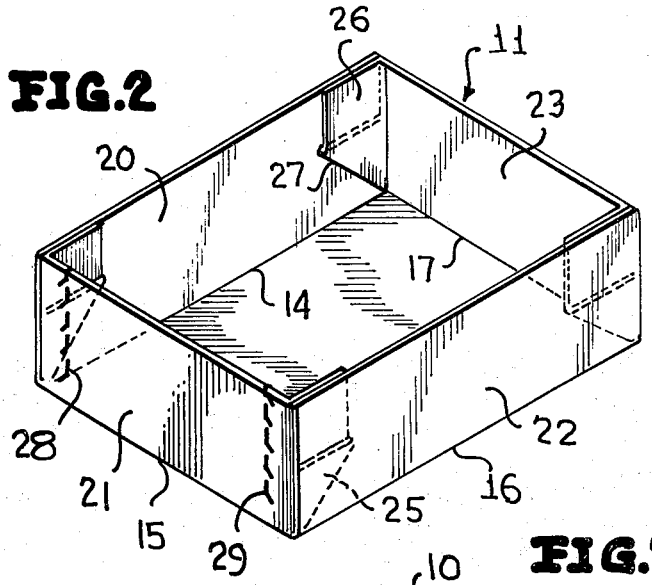
FIG. 6
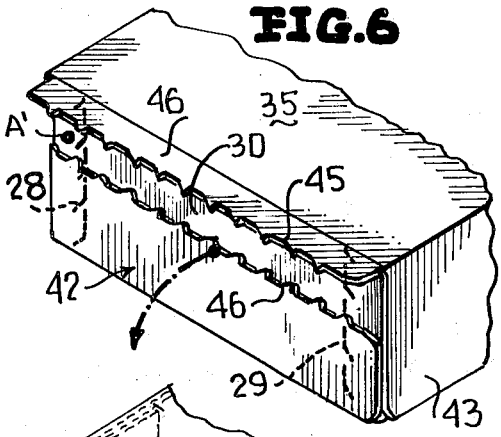
FIG. 7
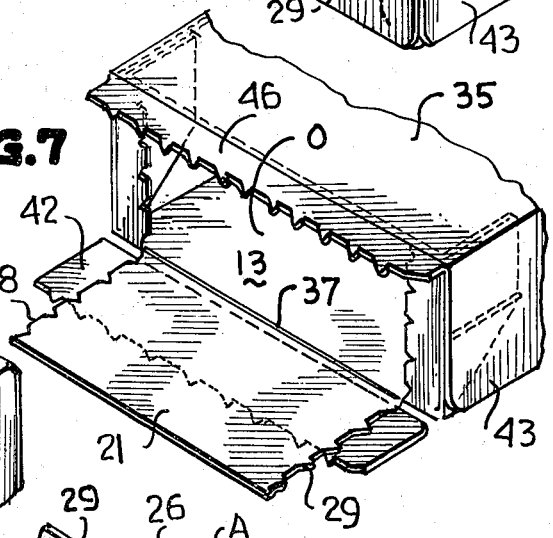
FIG. 5
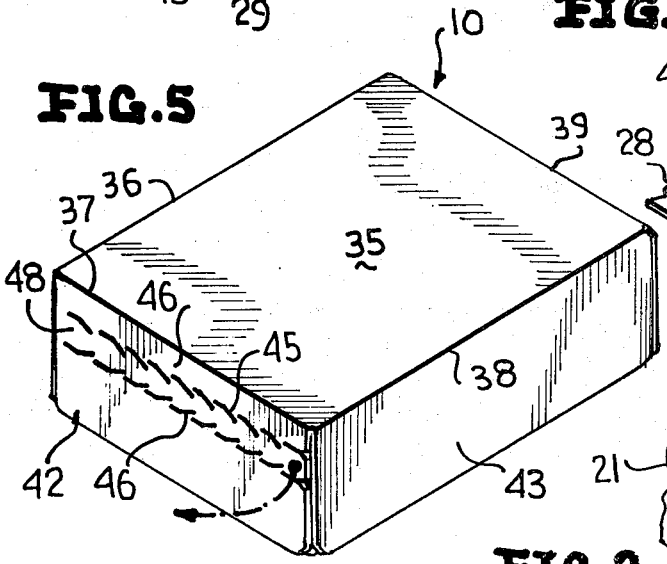
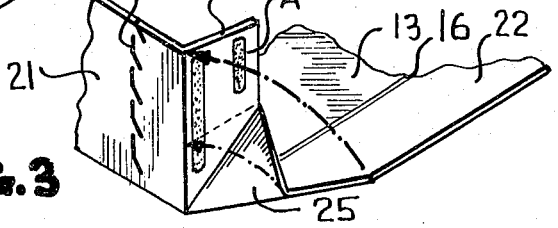
FIG. 3

METHOD OF FORMING, FILLING AND CLOSING CARTONS, AND SPECIFIC CARTONS THEREFOR

The present application constitutes a continuation-in-part of application Ser. No. 453,087 filed Mar. 20, 1974 now U.S. Pat. No. 3,927,505 entitled METHOD OF FORMING, FILLING AND CLOSING CARTONS, AND SPECIFIC CARTONS THEREFOR which in turn, is a divisional application of application Ser. No. 347,411 filed Apr. 3, 1973 entitled METHOD OF FORMING, FILLING AND CLOSING CARTONS, AND SPECIFIC CARTONS THEREFOR, which has since issued as Pat. No. 3,812,641 on May 28, 1974, both of the latter being in the name of ROBERT P. BEMISS.

The present invention is directed to the manufacture of hermetically sealed cartons which are particularly designed for the packaging of frozen foods which are normally of a perishable nature as, for example, vegetables and similar edible products. Several problems particularly to the frozen food industry and especially in the case of vegetables, are the undesired loss of moisture, changes in temperature which cause thawing and refreezing which results in less nutritious products, different private labeling for use on the same package, multiple styled cartons for different products, the bulky nature of cartons presently being used which interfere with packaging operations, undesired loss of moisture, and the cost and annoyance of over-wrapping operations, particularly in the case of change-over for different private labels. Though these examples of present problems are not all inclusive they do represent items which have caused rethinking in the packaging field to achieve a balance between low cost, high efficiency, and retail acceptance.

A solution of the latter-noted problems has been presented in the latter-specified application and patent, but in keeping with the present invention the disclosures thereof have been modified to further decrease and/or eliminate the problems set forth heretofore.

In keeping with the present invention a two-piece styled package is provided consisting solely of a carton body blank and a cover blank initially of a uniplanar configuration. However, contrary to the latter-defined disclosures the present invention is directed to a carton body in which side panels thereof are "flangeless", and simply terminate in free terminal edges which are contiguous to fold lines of a cover adjoining a top panel of the latter to side panels thereof. In this fashion the expense and difficulties of over-folding side panels of the cover along with side panels or flanges of the carton body are totally eliminated, yet by maintaining the terminal upper free edges of the carton body contiguous the fold lines of the cover between the top panel and the side panels or falnges a relatively tight seal is effected particularly when the product packaged therein is frozen.

As opposed to the carton constructions of the latter-noted applications, the present invention is directed to a carton body which excludes a "minor" or "body" flange. However, though these flanges have been eliminated the cover which remains unchanged still includes a top panel and four side panels or flanges thus presenting five panels for printing and/or decoration which is an approximate 1/5 increase as compared to present style containers. Moreover, nothing would preclude the bottom panel of the carton from being printed, typically with the usual cooking instructions when in its blank state or during movement along a packaging line. The latter offers an economy in the printing process since the cover has less material than the carton body and thus it is more economical to print the tops or covers in their flat state and the bottom panels of the cartons at any time prior to the erection, after the erection, or through discharge along the packaging line.

A primary advantage of the two-piece package of the present invention is that of avoiding the flanges of the carton body, thus presenting an increase in economy from simply the cost of material involved. Just as or perhaps more importantly is the fact that the over-wrapped operation is totally eliminated.

It is also highly desirable for the packaging industry to be able to employ only one style carton in which all products could be packaged thereby saving considerably in inventory, and again this problem is overcomed by the present invention in which the carton body can be plain unprinted paperboard and only the covers need be printed as desired depending upon the particular product packaged therein, which is preferably edible, as well as whatever might be the desires of individual customers. A customer could, for example, in keeping with the present invention employ the same unprinted carton for all products involved and the packager could have on hand differently printed covers to indicate the different products and/or packagers involved. Thus, the only change in the packaging system would be that of replacing one stack of covers for another during the packaging operation which is an extremely marked advantage over the present over-wrapped systems. Another fact which should be appreciated is that conventional wax paper and wax paperboard are used as over-wrapped stock and carton stock, respectively, but these materials do not provide the desired barrier characteristics to air, moisture and the like because the wax fractures easily during folding, wrapping and the like. Moreover, the absorption characteristics of the wax are detrimental from an aesthetic standpoint because they absorb oils, grease and similar materials which produce a characteristically darker area (stain) upon the package than nonstained areas.

Another advantage of the present invention is that of simplicity because beginning with the starting material (two paperboard blanks) both the cover and carton are rectangular or substantially rectangular and therefore waste material from scoring and cutting dies is minimal. Also, because of the rectangular nature of both designs the cover in particular can be supplied as individual blanks or in the form of material drawn from a roll which can be preprinted and cutoff to register approximately with the cartons to which it is applied. Obviously, the latter objective of providing the cover material in roll form simplifies shipping and handling because at the fabricating end casing would not be necessary as blanks would not be packaged whereas at the packaging end roll changes can be handled automatically. Also, a one-piece carton and cover can be easily filled, closed and sealed in essentially the same machine as that employed for the two-piece or roll form structure.

In keeping with a further object of this invention the package is provided with means for readily opening the same to dispense the packaged product therefrom, and in the preferred embodiment of the invention adjacent adhered side panels of the cover and carton body are provided with tear strips which are first operative to release an outer side panel of the cover which in turn provides access to a side panel of the carton body which when ruptured along associated weakening lines provides an access opening through which the product may be readily dispensed.

With the above and other objects in view that will hereinafter appear, the nature of the invention will be more clearly understood by reference to the following detailed description, the appended claimed subject matter and the several views illustrated in the accompanying drawings.

In the drawings

FIG. 1 is a top plan view of a novel carton blank constructed in accordance with this invention, and particularly illustrates the manner in which side panels are joined to each other by gusset panels and to a bottom panel by associated fold lines with one of the side panels being provided with a tear strip defined between spaced lines of weakening.

FIG. 2 is a perspective view of the carton blank of FIG. 1, and illustrates the same in its erected condition to define a generally polygonal configuration thereof.

FIG. 3 is a fragmentary perspective view of one of the four corners of the carton body of FIG. 2, and illustrates the manner in which each gusset is formed between adjacent side panels of the carton body.

FIG. 4 is a top plan view of a cover blank constructed in accordance with this invention, and illustrates the same formed of a top panel, four side panels or flanges, and one of the side panels or flanges being provided with a tear strip.

FIG. 5 is a perspective view of a package constructed in accordance with this invention, and illustrates the manner in which the cover and carton body are assembled and adhered to each other.

FIG. 6 is a fragmentary end view of the package of FIG. 5, and illustrates the manner in which a tear strip of a side panel of the cover is removed to initiate the removal of a portion of the side panel of the carton body.

FIG. 7 is fragmentary perspective view similar to FIG. 6, and illustrates the subsequent severence of a side panel of the carton body along weakening lines to permit the removal of a product from within the package.

Figure 8:
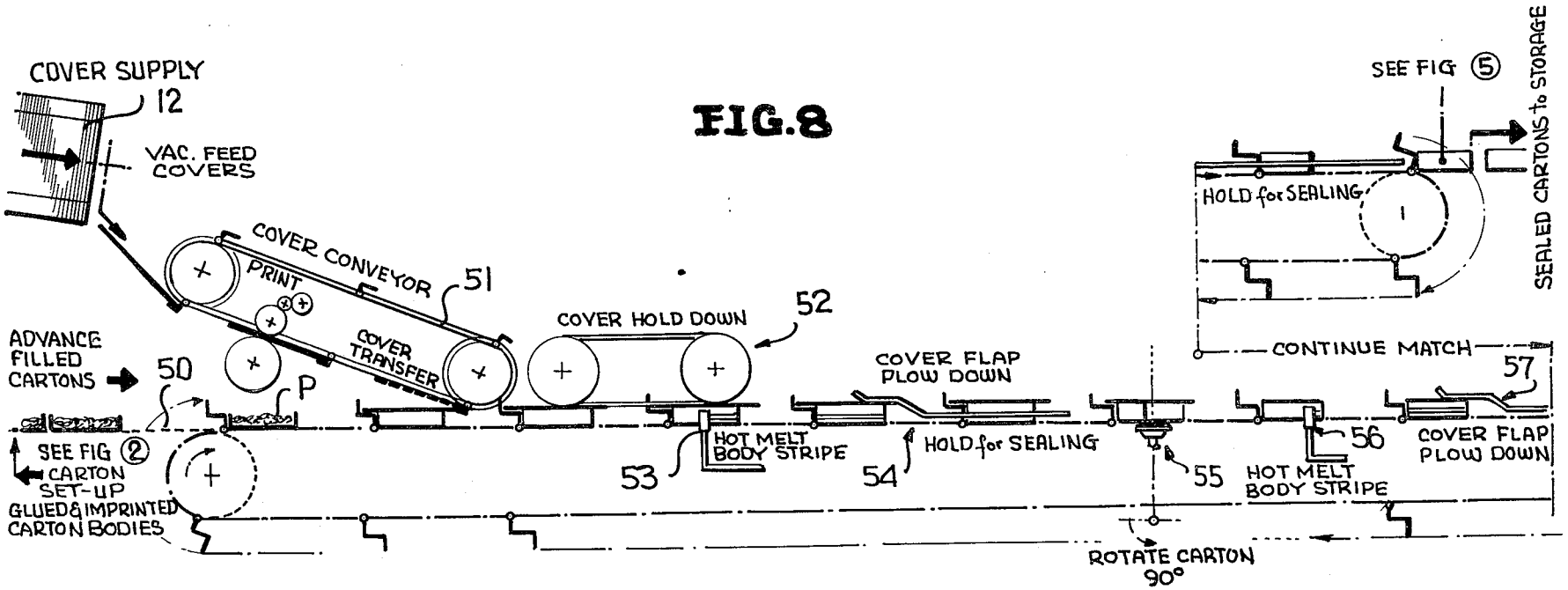
FIG. 8 is a diagrammatic side elevational view of a novel machine for performing the method of this invention by which the cartons and covers are united to house therein a specific product.

Reference is now made specifically to FIGS. 1 through 7 of the drawings which illustrate a package or carton 10 (FIG. 5) constructed in accordance with this invention which is formed by erecting a carton body blank 11 (FIG. 1) and a cover blank 12 (FIG. 4), and uniting the latter in conjunction with a product packaged therein.

Reference is specifically made to FIG. 1 of the drawings in which the carton body blank 11 is illustrated as a uniplanar piece of paperstock material defined by a bottom panel 13 set off by fold lines 14, 15, 16 and 17 imparting a generally polygonal configuration thereto. Four side panels or flanges 20, 21, 22 and 23 are joined by the respective fold lines 14 through 17 to the bottom panel 13. Identical gusset panels, each designated by the reference numeral 24 are provided at adjacent corners of the side panels 20 through 23, and each gusset panel 24 is defined by panel portions 25, 26 separated by an associated fold line 27. The panel portions 25, 26 are folded along the fold line 27 in the manner best illustrated in FIG. 3 and adhesive A is appropriately applied as necessary to adhere the gusset panel portions 25, 27 to each other as well as the side panels 20 through 23 to the associated gusset panel portions 26. Thus, in the manner best illustrated in FIG. 2 the erected or set-up condition of the carton body blank 11 defines a generally polygonal configuration with the side walls or panels 20 through 23 being generally normal to the bottom panel 13.

At least one of the side panels, in this case the side panel 21, is provided with a pair of spaced weakening lines 28, 29 which define therebetween a tear out portion 30. The weakening lines 28, 29 are disposed adjacent but slightly inboard of the fold lines 14, 16, respectively, and extend from a point just short of the fold line 15 to a free terminal edge 31 of the panel 21. It is to be particularly noted that the panel 21 is flangeless in that it terminates in a free terminal edge 31, as do the panels 20, 22 and 23 with the free terminal edges of the latter panels being designated by the respective reference numerals 32, 33, and 34.

The cover blank 12 (FIG. 4) is also constructed from a uniplanar piece of paperstock material and includes a top panel 35 provided with fold lines 36, 37, 38 and 39 which impart a generally polygonal configuration to the top panel 35. Side panels or flanges 41, 42, 43 and 44 are joined by the respective fold lines 36 through 39 to the top panel 35. The side panel 24 includes a pair of weakening lines 45, 46 which divide the side panel 42 into an upper panel portion 46 and a lower panel portion 47 with the area between the weakening lines 45, 44 being a tear strip 48. Adhesive A is disposed upon the lower portion 47 of the side panel 42 for adhering the same to a lower portion of the side panel 21 of the carton or carton blank 11.

After the carton 11 (FIG. 2) has been erected to the configuration illustrated in FIG. 2 a product, preferably edible, is deposited or packaged therein and thereafter the cover 12 is placed thereatop with the fold lines 36 through 39 generally contiguous to the fold lines 14 through 17 or 17 through 14, respectively. Adhesive pre-applied to various ones of the panels 41 through 44 and/or 20 through 23 permit these panels to be adhesively bonded to each other upon the downfolding of the panels 41 through 44, in the manner readily apparent from FIGS. 5 through 7 of the drawings. When thus downward folded and adhered it is to be particularly noted that the free terminal edges 31 through 34 of the carton body 11 are immediately adjacent the respective unnumbered free terminal edges of the panels 41 through 44 or vice versa. Hereagain, it is again stated that the side panels or walls 20 through 23 of the carton body 11 are devoid of flanges and thus the edges 31 through 34 thereof are immediately adjacent and generally aligned with the fold lines 37, 38, 39 and 36 of the cover 12.

In order to remove a product (not shown) from the interior of the package (FIGS. 5, 6 and 7), the tear strip 48 is grasped and a force applied thereto severs the same along the weakening lines 44, 45 in the manner clearly evident in FIG. 6. If desired a spot of adhesive A′ (FIG. 6) may be applied to a portion of the side panel 21 of the carton 11 in order that the tear strip 48 cannot be removed entirely from the package. However, upon the removal of the tear strip 48 it is to be particularly noted that the upper portion 46 of the panel 42 is free to hinge or pivot upwardly, as viewed in FIG. 6, about the fold line 36 thus permitting a users fingers to readily grasp the upper edge 31 of the panel 21 of the carton 10. In otherwords, the adhesive A permits the tear strip 48 to be readily removed from the panel 42 because of the natural resistance offered by the adhered panel portion 47 and the panel portion 46 united to the top panel 35 by the fold line 37. However, once a tear strip 48 has been removed the upper portion 46 of the side panel 42 will pivot upwardly, as viewed in FIG. 6, and a person can insert his fingers into the gap above the now fractured weakening line 44 to grasp the upper edge 31 of the panel 30 and draw the same downwardly to sever the panel portion 30 along the weakening lines 28, 29 in the manner illustrated in FIG. 7 to form an access opening O through which the packaged product can be readily dispensed. Thus, in keeping with this aspect of this invention the portion 47 of the side panel 42 is adhesively adhered to the panel 21 of the carton body 11 but preferably the tear strip 48 and the portion 46 is not adhered to the panel 21. Alternatively, a few spots of adhesive (not shown) may be provided to adhere the panel portion 46 to the side panel 21, but these should be readily fracturable in order that the panel portion 46 can pivot about the fold line 37 to the position shown in FIG. 6 to provide the access of a users fingers into the gap created between the fractured score line 44 and the upper edge of the panel 21 in order that the tear strip 30 can be grasped at or about the terminal edge 31 thereof and drawn downwardly to sever the score lines 28, 29 to form the opening O in the manner illustrated in FIG. 7.

Likewise, it is undesirable for the lower portion 47 of the side panel 42 to be adhesively secured to portions of the side panel 30 of the carton body 11 outboard of the weakening lines 28, 29 in order that upon the downward application of force to the tear strip 21 the entire lower portion 47 of the side panel 42 can be bodily removed from its normal adjacent relationship to the side panel 21 in the manner clearly illustrated in FIG. 7, noting in particular that the entire bottom portion 47 including extremeties thereof projecting beyond the lines of weakening 28, 29 are in tact and totally removed from the side panel 21.

Figure 9:
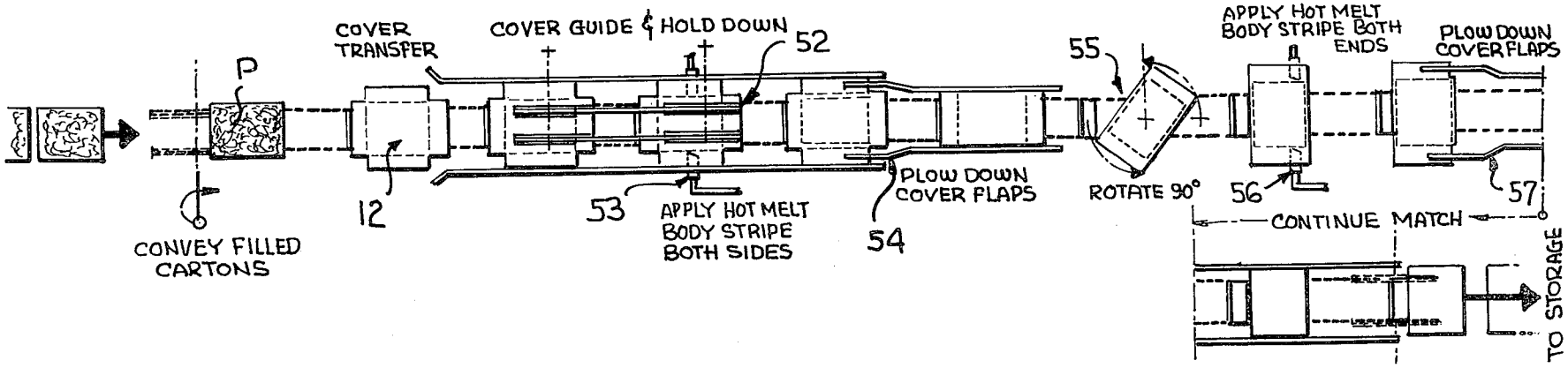
FIG. 9 is a top plan view of the arrangement illustrated in FIG. 8, and particularly illustrates the downfolding of side panels or flanges of the cover prior to and after rotation of the filled package.

Reference is now made to FIGS. 8 and 9 of the drawings which illustrate diagrammatically a machine corresponding to that disclosed in the latter-identified applications which basically is incorporated hereat by reference in order not to unduly lengthen this disclosure. Essentially, the method of this invention is practiced by providing a supply of covers 12 (FIG. 8) and a supply of carton body blanks 11 (not shown) in uniplanar form and setting up or erecting the carton body blanks 11 to form carton bodies of the configuration illustrated in FIG. 2 which are fed by conveying means 50 (FIG. 8) from left-to-right, as viewed in the latter-noted Figure. The individual uniplanar cover blanks 12 are withdrawn in a conventional manner by a conventional vacuum feed and are in turn fed to a cover conveyor 51 which is synchronized motion to that of the conveyor 50. A product P previously deposited or packaged within each of the cartons 11 is fed beneath the conveyor 51 and the covers 11 are deposited thereupon and held in assembled or unified relationship by a cover hold on mechanism 52, corresponding to that disclosed in the latter-identified applications. If the carton blanks 11 and/or the cover blanks 12 are not provided with an adhesive a suitable stripe or spots of hot-melt adhesive are applied to the side panels 20, 22 or 21, 23 of the carton 11 by a conventional extruder 53. Alternatively, these same stripes can be applied to the side panels 41, 43 or 42, 44 of the cover blank 12.

Thereafter during the conveyance of the now assembled cartons 11 and covers 12 the flanges or side panels 41, 43 or 42, 44 of the cover 12 are folded or plowed downwardly by side guides 54 and are held in intimate contact with the side panels 20, 22 or 21, 23 of the carton 11. Thus, two of the opposite side panels 41, 43 or 42, 44 of the cover 12 are brought into adhesive bonding contact with the side panels 20, 22 or 21, 23, respectively, of the carton 11.

The conveyance of the thus assembled cover, carton body and the product disposed therein is held for a certain time period by an extension of the plows 54 in order to assure that sealing occurs between the folded down flaps of the cover 12 and the associated flaps or side panels of the carton body 11.

After the sealing of two side panels of the cover 12 relative to the two side panels of the carton body 11 means 55 are provided for rotating the unified package 90° in order that the remaining side panels 41, 43 or 42, 44 of the cover 12 can be again processed by applying thereto adhesive from a hot-melt extruder 56 followed by another downfolding of these side panels by a plow or folder bars 57, again in the manner disclosed in the latter-noted applications. At the termination of this downward folding the package is completed and corresponds to that illustrated in FIG. 5.

It is particularly pointed out that the adhesive A (FIG. 4) may be applied by either of the extruders 53, 56, or preapplied while the cover 12 is still in its uniplanar condition. The important fact is that neither of the extruders 53, 56 applies adhesive to the tear strip 48 or to the portion 46 thereabove in order to achieve the ready ease of opening heretofore described specifically in regard to FIGS. 6 and 7 of the drawings.

While preferred forms and arrangement of parts have been shown in illustrating the invention, it is to be clearly understood that various changes in details and arrangement of parts may be made without departing from the scope and spirit of this disclosure.

I claim:

1. A package consisting solely of a cover, a carton body, and an edible product in said carton body, said carton body being defined by a bottom panel and four upstanding side panels generally normal thereto, a gusset panel between adjacent side panels of said carton body, said gusset panel being defined by a pair of panel portions overfolded into contiguous relationship to each other, adhesive means bonding said gusset panels and side panels to maintain a generally polygonal configuration to said four upstanding side panels as viewed in top plan, each of said side panels terminating in a free terminal edge, said cover including a top panel and four side panels joined thereto along associated fold lines, said cover being disposed upon said carton body with the fold lines thereof contiguous said free terminal edges, said cover and carton body side panels being directly bonded to each other, cooperative means between one of said carton body side panels and an overlying one of said cover side panels for rupturing both of the latter to provide an access opening for the removal of the edible product, said cooperative means including a narrow tear strip in said one cover side panel running generally the length thereof between end edges of said one cover panel, and said cooperative means further including a wide tear strip in said one carton body side panel running generally the height thereof whereby upon the removal of said narrow tear strip said one cover side panel is ruptured to permit access to and rupture of said carton body side panel wide tear strip.

2. The package as defined in claim 1, wherein said wide tear strip is defined by a pair of spaced weakening lines extending generally between a fold line joining said one carton body side panel to said bottom panel and a free terminal edge of said one carton body side panel.

3. The package as defined in claim 1, wherein said weakening lines are spaced from each other a distance approximating the length of said one cover side panel whereby upon the rupture of said wide tear strip along the spaced weakening lines thereof there is formed an opening in said one carton body side panel corresponding generally to but slightly less than the overall dimension of said one carton body side panel to readily permit the removal of the edible product therethrough.

4. The package as defined in claim 1 wherein said carton body is devoid of indicia, and only the cover includes indicia representative of the edible product.

5. The package as defined in claim 4, wherein said wide tear strip is defined by a pair of spaced weakening lines extending generally between a fold line joining said one carton body side panel to said bottom panel and a free terminal edge of said one carton body side panel.

6. The package as defined in claim 5 ,wherein said weakening lines are spaced from each other a distance approximateing the length of said one cover side panel whereby upon the rupture of said wide tear strip along the spaced weakening lines thereof there is formed an opening in said one carton body side panel corresponding generally to but slightly less than the overall dimension of said one carton body side panel to readily permit the removal of the edible product therethrough.

7. An easy opening package comprising a carton body and a cover, said carton body including a bottom panel and four upstanding side panels, one of said side panels being defined by a fold line joining the same to said bottom panel, a pair of spaced side edges, and a free terminal upper edge, said cover including a top panel and four depending side panels, said cover side panels being joined by fold lines to said top panel, at least one of said cover side panels being overfolded directly against one of said carton body side panels about a first fold line, a tear strip formed in said one cover side panel, said tear strip dividing said one cover side panel into upper and lower panel portions with said tear strip therebetween, means primarily bonding said lower panel portion to said one carton body side panel, and said one carton body side panel including a pair of spaced weakening lines between and inboard of said spaced side edges disposed between said fold line and said free terminal edge.

8. The package as defined in claim 7, wherein said upper panel portion is relatively free to hinge about a fold line joining it to said top panel to permit one to grasp the free terminal edge of said one carton body side panel for rupturing the same downwardly along said weakening lines toward said first fold line.

* * * * *